United States Patent [19]

Kaminaka et al.

[11] Patent Number: 4,914,425

[45] Date of Patent: Apr. 3, 1990

[54] HIGHLY SENSITIVE SMOKE DETECTOR

[75] Inventors: Yoshinori Kaminaka, Sagamihara; Hiroshi Yashima, Shibata; Satoru Koizumi, Hachioji; Tetsuya Nagashima, Tokyo; Yoshihito Hirai, Odawara; Tetsuji Sato, Sagamihara, all of Japan

[73] Assignee: Hochiki Corporation, Tokyo, Japan

[21] Appl. No.: 285,802

[22] Filed: Dec. 16, 1988

[30] Foreign Application Priority Data

Dec. 26, 1987 [JP] Japan ..... 62-198632

[51] Int. Cl.[4] ..... G08B 17/10

[52] U.S. Cl. ..... 340/693; 340/628

[58] Field of Search ..... 340/693, 629, 628, 630

[56] References Cited

U.S. PATENT DOCUMENTS 4,328,424 5/1982 O'Connor ..... 340/629

4,623,878 11/1986 Schoenwetter ..... 340/629

*Primary Examiner*—Glen R. Swann, III

*Attorney, Agent, or Firm*—Lackenbach, Siegel, Marzullo & Aronson

[57] ABSTRACT

An ionization smoke detector of the present invention comprises an outer electrode having a plurality of smoke inlets formed on a side wall thereof, an outer cover and a partition wall having a plurality of smoke inlets disposed between the outer electrode and the outer cover to form a triple wall structure. The smoke inlets formed on the outer cover, the partition wall and the outer electrode are staggered from each other. Air stream hitting against the detector is attenuated by the triple wall structure and generally half of the air flow is allowed to pass between the outer cover and the outer electrode and between the partition wall and the outer electrode, flowing out of the detector and the remaining half of the air flow is led into the detector through the smoke inlets.

4 Claims, 3 Drawing Sheets

HIGHLY SENSITIVE SMOKE DETECTOR

BACKGROUND OF THE INVENTION

1. Field of the Invention

This invention relates to an ionization smoke detector which detects a fire by detecting a change of an ionization current caused by a change of a smoke density by using a radiation source.

2. Prior Art

When an ionization smoke detector of this type which is installed on a ceiling, it is subject to air stream from a blowout of an air conditioner, it might possibly cause a malfunction because the air stream entering the detector reduces an ionization current within a chamber as by smoke entry. For this reason, a conventional ionization smoke detector generally has a specific smoke intake structure for preventing direct flow of air into the chamber.

As a specific example of the smoke intake structure for preventing possible malfunction, there may be mentioned a structure as disclosed in Japanese Utility Model Application Kokai No. 56-9053. In an ionization smoke detector disclosed in this reference, double partition walls with air inlets formed on respective side wall are provided and the smoke inlets on the outer partition wall and the smoke inlets on the inner partition wall are staggered from each other. Therefore, when the detector is subject to external air stream, it can allow the air stream partially to pass between the outer and inner partition walls, thereby reducing direct air flow into the chamber for preventingt possible malfunction.

With such a structure that the double smoke inlet structure is formed and the smoke inlets are arranged so as to be staggered from each other in the structure, however, direct flow into the chamber would be increased to possibly cause a malfunction when the air stream is strong.

To reduce the influence by the air flow into the chamber when the air stream is hard, an opening area of the smoke inlet formed on the partition wall may be decreased. However, if the opening area of the smoke inlet is decreased, air flow passing between the partition walls is increased to render the interior pressure of the chamber negative. This may possibly be another cause for malfunction. Besides, this causes undesirable insufficiency in detection sensitivity which is lowered due to lack in amount of smoke entering the chamber when a fire occurs.

OBJECT AND SUMMARY OF THE INVENTION

The present invention has been made to overcome the problems as described above and it is an object of the present invention to provide an ionization smoke detector which is capable of operating normally without causing a mis-operation even when it is subject to strong air stream and is capable of leading a sufficient amount of smoke into a chamber when a fire starts.

To attain the object, the present invention features an ionization smoke detector having a detector body with an inner electrode mounted therein and, an outer electrode formed in a cup-like shape and having a side wall with a plurality of smoke inlets which surrounds said inner electrode and an outer cover having a side wall with a plurality of smoke inlets which surrounds said outer electrode, which detector is characterized in that a cylindrical partition wall having a plurality of smoke inlets is provided between said outer cover and said electrode to form a triple wall structure and that smoke inlets of the outer cover, partition wall and outer electrode are staggered from each other.

With this arrangement, generally half of the air stream the detector receives is led into the detector, while allowing the remaining half to flow outside the detector. Thus, when the detector is subjected to hard air stream, it can operate normally without causing malfunction, thereby to improve the reliability of the detector. Furthermore, when a fire occurs, substantially half or more of smoke which the detector receives can be led into the outer chamber. Thus, sufficient amount of smoke can be assured for fire detection, maintaining a sufficient response for smoke detection.

In the detector, the side walls of the outer electrode and the outer cover may be slanting so as to widened upwardly and the partition wall may be upright vertically.

In this arrangement, the smoke inlets are formed vertically and slantingly and cooperate with the triple wall structure to effectively attenuate the air stream. As a result of this, air flow can be surely reduced to a desired level.

In the detector, a fly-screening net may preferably be provided along a side wall of the partition wall. This will partially shut out the air stream through the smoke inlets and effectively reduce the air flow.

In the detector, the widths of the wall portions of the outer electrode and the outer cover may be the same as or more than that of the smoke inlets of the partition wall. This will again ensure the effect of reducing the air flowing into the detector.

PREFERRED EMBODIMENT OF THE PRESENT INVENTION

Figure 1:
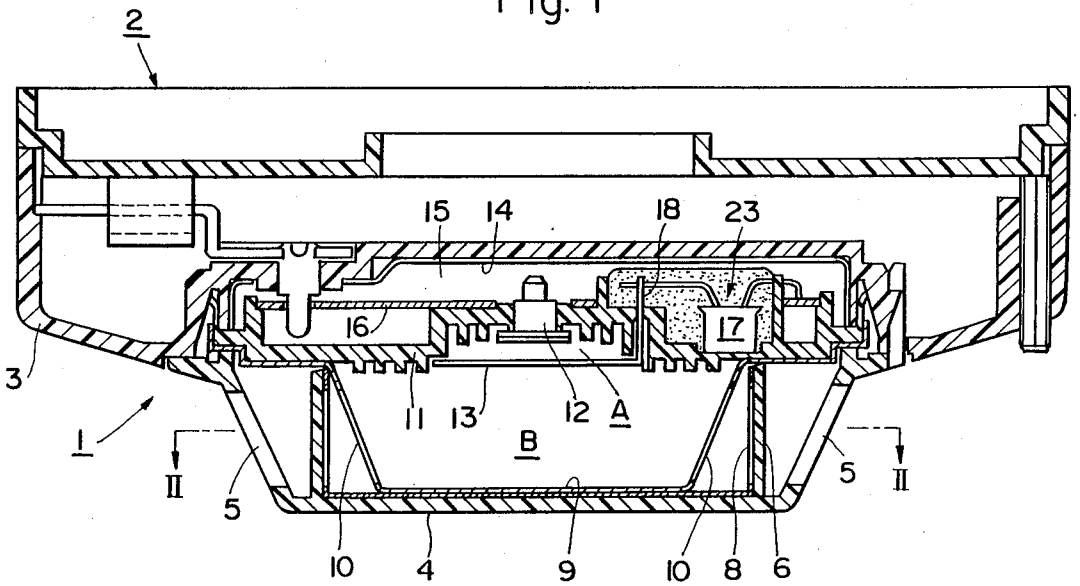
FIG. 1 is a sectional view of one form of an ionization smoke detector according to the present invention.

FIG. 1 is a sectional view of one embodiment of the present invention.

In FIG. 1, 1 is a detector body and 2 is a detector base. The detector base 2 is installed on a ceiling and the detector body 1 is removably mounted on the detector body 1.

The detector body 1 comprises a body cover 3 adapted to be fitted to the detector base 2 and an outer cover 4 which is fitted, in turn, to the body cover 3.

The outer cover 4 has a cup-like shape opened at a top thereof and has a sloping peripheral wall, broadening upwardly to form a truncated conical shape in the embodiment as illustrated. The sloping side wall has a plurality of smoke inlets 5. The smoke inlets 5 are formed in about square or rectangular shapes and provided at regular intervals. In the embodiments as illustrated, the ratio of the width of the smoke inlet 5 of the slanting peripheral wall to a width of the remaining wall portion of the peripheral wall is 2.5:1.

Figure 2:
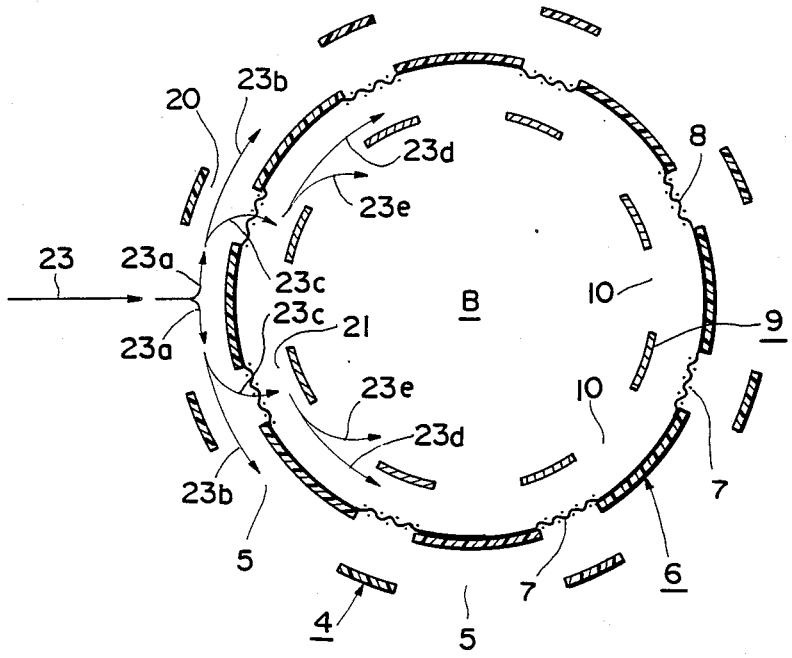
FIG. 2 is an end view taken from a line II—II of FIG. 1.
Figure 3:
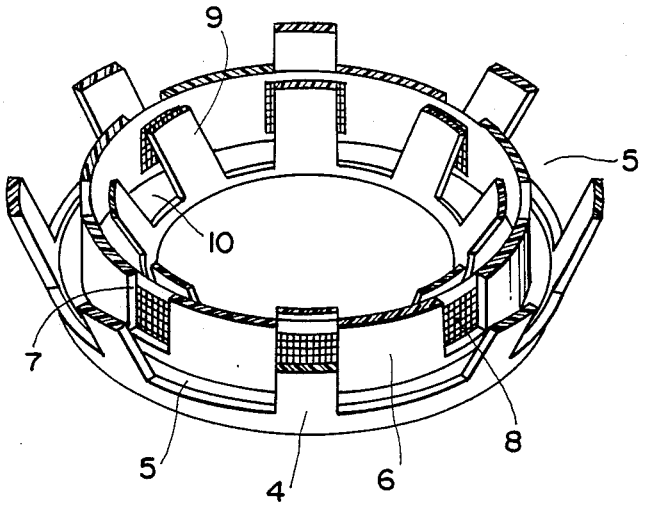
FIG. 3 is a sectional perspective view taken along a line II—II of FIG. 1.

An upstanding cylindrical partition wall 6 is integrally formed inside the slanting peripheral wall of the outer cover having the smoke inlets 5. This partition wall 6 also has a plurality of square or rectangular smoke inlets 7 provided at regular intervals as best seen in FIGS. 2 and 3.

A fly screening net 8 is provided on the inside of the partition wall 6 which is formed inside the outer cover 4. The fly-screening net 8 has the same height as the partition wall 6 and is fixed closely to the inner surface of the partition wall 6.

An outer electrode 9 is furthre provided inside the fly-screening net 8 within the outer cover 4. The outer electrode 9 is formed having a cup-like shape identically with the outer cover 4. The outer electrode 9 also has a slanting peripheral wall with a plurality of about square or rectangular smoke inlets 10 formed at regular intervals.

An insulating block 11 is mounted in the detector body 1. An inner electrode 12 with a radiation source is placed centrally in the insulating block 11. An intermediate electrode 13 with an opening is also mounted adjacent to the inner electrode 12. An inner ionization chamber A is defined between the inner electrode 12 and the intermediate electrode 13, while an outer ionization chamber B is defined between the intermediate electrode 13 and the outer electrode 9.

A circuitry-encasing space 15 is provided on the backside of the insulating block 11. The circuitry-encasing space 15 has a shield case at an upper portion thereof. A printed circuit board 16 in which a detector circuitry is packaged is mounted closely on the backside of the insulating block 11. Further, on the backside of the insulating block 11 there is provided an FET-encasing portion 23 where FET 17 and an electrode lead 18 for the intermediate electrode 13 are potted with a hot melt resin, for example a hot melt synthetic resin so as to be insulatedly sealed.

FIG. 2 is an end view taken from a line II—II of FIG. 1 showing a smoke flow and FIG. 3 is a sectional perspective view taken along a line II—II of FIG. 1. In the figures, a triple structure is formed outside the outer ionization chamber B by the peripheral wall of the outer electrode 9, partition wall 6 and the outer cover 4.

The smoke inlets 5 of the outer cover 4, the smoke inlets 7 of the partition wall 6 and the smoke inlets 10 of the outer electrode 9 are arranged staggeredly so as not to coincide with the smoke inlets of the adjacent walls. More particularly, the smoke inlets 5 of the outer cover 4 face the wall portions of the partition wall 6 and the smoke inlets 7 of the partition wall 6 face the wall portions of the peripheral wall of the outer electrode 9. In the embodiment as illustrated, the wall portions of the outer cover 4 are identical in width with the wall portions of the outer electrode 9 and further identical in width with the smoke inlets 7 of the partition wall 6. With this arrangement, air flow directly entering the outer ionization chamber B from the outside is suppressed.

Furthermore, bypasses 20, 21 are formed by the triple wall structure of the outer cover 4, the partition wall 6 and the outer electrode 9 between the outer cover 4 and the partition wall 6 and the partition wall 6 and the outer electrode 9, respectively, for letting air entering through the inlets 5 and 7 pass therethrough.

An operation of the present invention will now be described.

When the ionization smoke detector as illustrated in FIG. 1, which is installed on the ceiling, is subject to air flow blown off from an air conditioner, laterally along the ceiling, generally half of the air flow which hits against the detector is allowed to enter the outer ionization chamber B within the outer electrode 9 according to the air flow mechanism as illustrated in FIGS. 2 and 3 and the remaining half is allowed to flow outside the detector.

More particularly, when the detector receives air flow as indicated by arrow 23, the air passed through the smoke inlets 5 located at the outermost position hits against the partition wall 6 located inside thereof and is divided as shown by arrows 23*a*, 23*a*. The air streams thus formed partially flow through the bypass 20 as indicated by arrow 23*b* and partially flow into the inside of the partition wall 6 through the smoke inlets 7 as indicated by arrows 23*c*. The air flows entering through the smoke inlets 7 as shown by 23*c* hit against the outer electrode 9 to be partially led into the outer ionization chamber B through the smoke inlets 10 as shown by 23*e* and partially allowed to flow out through the bypass 21 between the partition wall 6 and the outer electrode 9 as shown by 23*d*.

With the triple wall structure with the smoke inlets 5, 7 and 10, half or so of the air hit against the detector are led into the outer ionization chamber B and the remaining half is allowed to flow out through the bypasses 20, 21 between the outer cover 4 and the partition wall 6 and the partition wall 6 and the outer electrode 9, respectively.

Furthermore, as can be seen from FIG. 3, the smoke inlets 4 of the outer cover 4 and the smoke inlets 10 of the outer electrode 9 open on the slanting walls widening upwardly and the smoke inlets 7 open on the upright wall of the partition wall 6 located intermediate between the outer cover 4 and the outer electrode 9. In other words, the smoke inlets 5, 7 and 10 are formed in such a manner that they open slantingly, vertically and slantingly, respectively. This formation provides sufficient attenuation or damping effect to the air stream hit against the detector. This cooperates with the triple wall structure for the smoke inlets 5, 7 and 10 to surely reduce the air flow entering into the outer ionization chamber B as shown in FIG. 2.

In addition to this, the present invention can provide another solution of the problems involved in the conventional detector. In the conventional detector, when strong air stream hits against the detector, a large difference in pressure is caused between the outside and inside of the detector by the action of the air stream passing outside the detector. As a result of this, the internal pressure of the outer ionization chamber B is reduced to negative, which allows ions to flow away. Thus, undesirable mis-operation might possibly be caused. According to the present invention, air flow entering into the detector is attenuated by the triple wall or smoke inlet structure as shown in FIG. 2, allowing half of the air flow to pass through the bypasses 20, 21 and letting the remaining half enter the outer ionization chamber B. This can minimize a pressure difference between the outside and the inside of the detector. Therefore, even if the detector is subject to strong air stream, it can operate accurately and stably without causing misalarming.

And in the conventional detector,when air stream enter into the detector, a inner pressure of the detector goes up. As a result of this, undesirable mis-operation might possibly be caused. According to the present invention, because air flow entering into the detector is effectively attenuated by the triple wall, a inner pressure remains near normal condition. Therefore, even if air stream enter into the detector, it can operate accurately and stably without causing mis-alarming.

Further, the fly-screening net 8 provided on the inside of the partition wall 6 partially shuts out the air stream entering though the smoke inlets 7. Thus, the air flow is further effectively reduced.

Although the smoke inlets 7 are formed on the upright partition wall 6 in the embodiment as illustrated, the smoke inlets 7 of the partition wall 6 may be formed by other types of nets instead of the fly-screening net 8.

The sizes and the numbers of the smoke inlets 5, 7 and 10 are not limited to those of the embodiment as illustrated. They may be determined according to the necessity.

What is claimed is:

1. An ionization smoke detector comprising a detector body with an inner electrode mounted therein and an outer electrode, said outer electrode having a cup-like shape, a side wall of said outer electrode being provided with a plurality of smoke inlets surrounding said inner electrode, and an outer cover having a side wall with a plurality of smoke inlets surrounding said outer electrode, said smoke detector further comprising a cylindrical partition wall having a plurality of smoke inlets provided between said outer cover and said outer electrode to form a triple wall structure, said smoke inlets of the outer cover, partition wall and outer electrode being staggered from each other.

2. An ionization smoke detector as claimed in claim 1, in which the side walls of the outer electrode and the outer cover are slanted so as to widened upwardly and the partition wall is upright vertically.

3. An ionization smoke detector as claimed in claim 1, in which a fly-screening net is provided along a side wall of the partition wall.

4. An ionization smoke detector as claimed in claim 1, in which the widths of the side wall of the outer electrode and the width of the outer cover are at least the same as the width of the smoke inlets of the partition wall.

* * * * *